United States Patent [19]

Maier

[11] Patent Number: 4,816,740

[45] Date of Patent: Mar. 28, 1989

[54] MODE OPTIMIZED D.C. POWER SUPPLY

[75] Inventor: Craig P. Maier, Verona, N.J.

[73] Assignee: Hewlett-Packard Company, Palo Alto, Calif.

[21] Appl. No.: 145,074

[22] Filed: Jan. 19, 1988

[51] Int. Cl.[4] ..... G05F 1/46

[52] U.S. Cl. ..... 323/275; 323/285

[58] Field of Search ..... 323/222, 224, 225, 226, 323/266, 275, 285, 209

[56] References Cited

U.S. PATENT DOCUMENTS 3,303,411 2/1967 Gately ..... 323/275

3,414,803 12/1968 Glasgow et al. ..... 323/275

*Primary Examiner*—Patrick R. Salce

*Assistant Examiner*—Kristine Peckman

*Attorney, Agent, or Firm*—Donald N. Timbie

[57] ABSTRACT

A D.C. power supply in which the output capacitor used in the CV mode of operation is removed from the output circuit in the CC mode of operation and charged to the voltage between the output terminals so as to prevent transients or switch stressing that could be caused when the output capacitor is reconnected to the output circuit for CV operation. In a preferred embodiment, first and second FET's are connected in series between the input and output terminals of the supply. While the first is used for control during CV operation, the second is in saturation, and while the second is used for control during CC operation, the first is in saturation. The output impedance of the supply is decresed during CV operation by connecting the source electrode of the first FET to the output electrode, and the output impedance of the supply is increased during CC operation by connecting the drain electrode of the second FET to the output electrode.

6 Claims, 2 Drawing Sheets

MODE OPTIMIZED D.C. POWER SUPPLY

BACKGROUND OF THE INVENTION

Direct current power supplies are generally designed for optimum performance in a constant voltage mode (CV) or in a constant current mode (CC). In either case there is a "limit" mode of operation at which the supply automatically switches from one mode to the other. Specifically when a constant voltage supply, CV, reaches a current output such that CV/CC≧RL, wherein CV is the constant voltage setting , CC is the constant current setting and RL=the load resistance, it switches into a constant current mode and when a constant current supply reaches a current such that CV/CC≧RL, it switches to a constant voltage mode.

A power supply optimized for CV operation should approach zero output impedance at all frequencies, and a power supply optimized for CC operation should approach an infinite output impedance at all frequencies.

A power supply optimized for CV operation generally has a large output capacitor connected between its output terminals that minimizes the output impedance for the CV mode but impairs its transient response for varying loads when operating in a CC mode.

A power supply optimized for CC operation usually does not have an output capacitor connected between its output terminals, but the lack thereof causes a poorer load effect transient response when operating in CV mode.

BRIEF SUMMARY OF THE INVENTION

In accordance with a first aspect of this invention, an output capacitor is connected between the output terminals of a power supply when it is operating in a CV mode and is disconnected therefrom when the power supply is operating in a CC mode.

In accordance with a second aspect of this invention, means are provided for charging and discharging the output capacitor to the voltage between the output terminals when it is disconnected therefrom during CC operation, thereby preventing output transients from being produced when CV operation is resumed.

In accordance with a third aspect of the invention, a P channel FET (or PNP bipolar Transistor) having its source and drain electrodes (emitter and collector electrode) respectively closer to input and output terminals of the supply is used as a series pass resistance having the high output impedance desired for CC operation.

In accordance with a fourth aspect of this invention, an N channel FET (or NPN Bipolar Transistor) having its drain and source electrodes (collector and emitter) respectively closer to the input and output terminals of the supply is used as a series pass resistance having a low output impedance desired for CV operation.

In a preferred embodiment of the invention P channel and N channel FET's are connected in series and controlled in such manner that the P channel FET is saturated when the output voltage is being controlled by the N channel FET during CV operation and the N channel FET is saturated when the output current is being controlled by the P channel FET during CC operation.

DETAILED DESCRIPTION OF THE INVENTION

Figure 1:
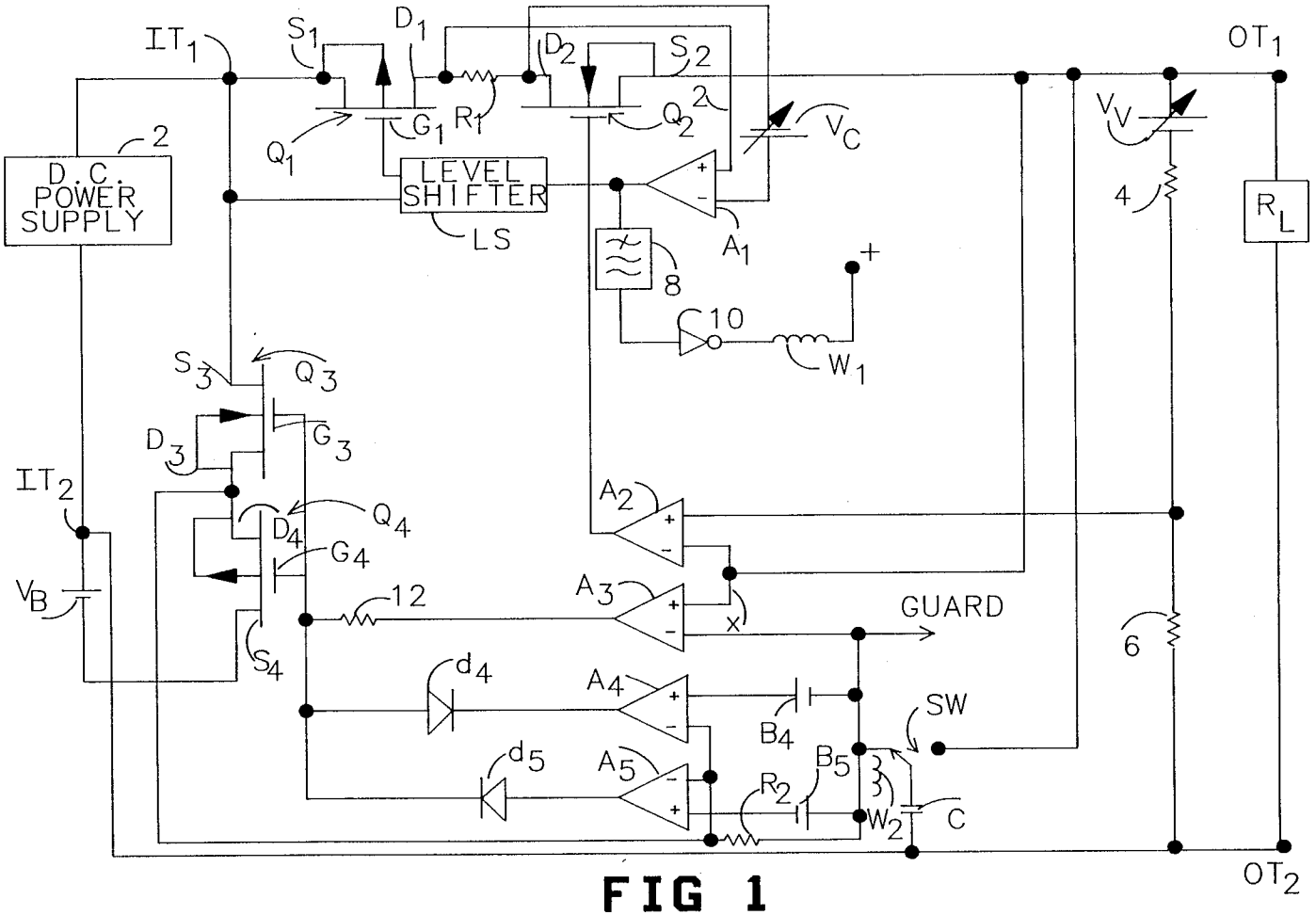
FIG. 1 is a schematic diagram of a preferred embodiment of the invention.

Reference is made to the schematic diagram of FIG. 1 illustrating one form of a preferred embodiment of the invention wherein an unregulated source 2 of D.C. voltage is connected between input terminals $IT_1$ and $IT_2$. Two series pass FET's $Q_1$ and $Q_2$ are connected in series with a resistor $R_1$ between the input terminal $IT_1$ and an output terminal $OT_1$. The input terminal $IT_2$ is directly connected to an output terminal $OT_2$ and a load RL is connected between the output terminals $OT_1$ and $OT_2$. $Q_1$ is a P channel FET having its source electrode S, connected to $IT_1$, and its drain electrode $D_1$ connected to $R_1$. $Q_2$ is an N channel FET having its drain electrode $D_2$ connected to $R_1$ and its source electrode connected to the output terminal $OT_1$.

CC operation is controlled by an operational error amplifier $A_1$ having its non-inverting input connected to $D_1$, its inverting input connected to $D_2$ via a variable D.C. voltage source Vc and its output electrode coupled via a level shifter LS to the gate electrode $G_1$ of $Q_1$. As the load RL changes so as to vary the current through $R_1$, $A_1$ varies the resistance of $Q_1$ in such manner as to keep the current very close to the value determined by the voltage supplied by Vc. During CC operation $Q_2$ is saturated so as to have little series resistance.

The connection of the drain electrode $D_1$ to $OT_1$ aids in providing a high output impedance for the power supply, but a significantly higher output impedance can be attained if an output capacitor C that is connected between $OT_1$ and $OT_2$ during CV operation is removed from the output circuit by placing a switch SW that is in series with C in the position shown. The switch SW may be controlled in any suitable manner as by connecting a relay winding $W_1$ in series with a low pass filter 8 and an inverting amplifier 10 between the output electrode of $A_1$ and a point of positive voltage and coupling $W_1$ to a winding $W_2$ that moves SW to the position shown when current flows in $W_1$. Whereas SW is shown as an electromagnetic switch it could be a solid state switch.

CV operation is controlled by an operational error amplifier $A_2$ having its non-inverting input connected to the junction of resistors 4 and 6 that are connected in series with a variable D.C. voltage source between $OT_1$ an $OT_2$. The inverting input of $A_2$ is connected to $OT_1$, and its output electrode is connected to the gate $G_2$ of $Q_2$. As the load $R_L$ changes so as to vary the output current, $A_2$ varies the resistance of $Q_2$ in such manner as to keep the output voltage very close to the value determined by the value of resistor 6 divided by the value of the resistor 4 times $V_v$. During CV operation $Q_1$ is saturated so as to have little resistance.

During CV operation the connection of the source electrode $S_2$ of $Q_2$ to $OT_1$ aids in providing a low output impedance for the supply. Further decrease in impedance as well as good transient response is attained by the fact that no current flows in $W_1$ so as to permit SW to connect the output capacitor C between $OT_1$ and $OT_2$.

Whereas the removal of the output capacitor C from the output circuit during CC operation increases the output impedance of the power supply as desired, an arc may be drawn by the switch SW and/or an output transient could be produced when CV operation is resumed and SW returns to the position that connects C between $OT_1$ and $OT_2$. This is prevented in accordance with another aspect of the invention by provision of means for charging or discharging C during CC operation so that the voltage across it follows the output voltage between $OT_1$ and $OT_2$.

Control of the charge and discharge of the output capacitor C is effected by an operational amplifier $A_3$ having its noninverting input connected to $OT_1$ and its inverting input connected via a resistor $R_2$ to the drain electrodes $D_3$ and $D_4$ of FET's $Q_3$ and $Q_4$ that are connected in series with a D.C. saturation compensation voltage source $V_B$ between $S_4$ and $IT_2$. The output electrode of $A_3$ is connected via a resistor 12 to the gate electrodes $G_3$ and $G_4$ of $Q_3$ and $Q_4$ respectively. The saturation compensation voltage source $V_B$ permits $Q_4$ to operate down to zero volts. A guard connection is made to the inverting input of $A_3$.

As the voltage at $OT_1$ increases, the output of $A_3$ becomes more positive and current flows through $Q_3$, the resistor $R_2$ and the switch SW so as to increase the voltage on the output capacitor C. If the voltage at $OT_1$ decreases, so as to be less than the voltage across C, the output of $A_3$ becomes negative so as to turn on $Q_4$ and permit current to flow from C via the switch SW to $IT_2$ via $V_B$.

When the power supply is operating in the CC mode, step changes in output voltage can occur that are not large enough to cause the power supply to change to CV operation and yet large enough to damage $Q_3$ or $Q_4$. A protection circuit is therefore provided that is comprised of operational amplifiers $A_4$ and $A_5$ having their non-inverting inputs respectively connected via reference voltages $B_4$ and $B_5$ to the side of the resistor $R_2$ that is connected to the switch SW. Their inverting inputs are connected to the opposite side of $R_2$. The output of $A_4$ is connected via a diode $d_4$ to the gates $G_3$ and $G_4$, and the output of $A_5$ is connected via a diode $d_5$ to the gates $G_3$ and $G_4$. The diodes $d_4$ and $d_5$ are oppositely poled. When sufficient current is flowing toward the output capacitor C through $Q_3$ to make the inverting inputs of the amplifier $A_4$ have a greater voltage than is applied to its non inverting input by the source $B_4$, the output of $A_4$ becomes negative so that control current from $A_3$ flows through the resistor 12, $d_4$ and $A_4$ to the common for the operational amplifier $A_3$, $A_4$ and $A_5$, not shown, that would be connected to guard. The circuit for $A_5$ operates in a similar manner (so as to protect $Q_4$) when the voltage across the load steps in the other direction.

Figure 1A:
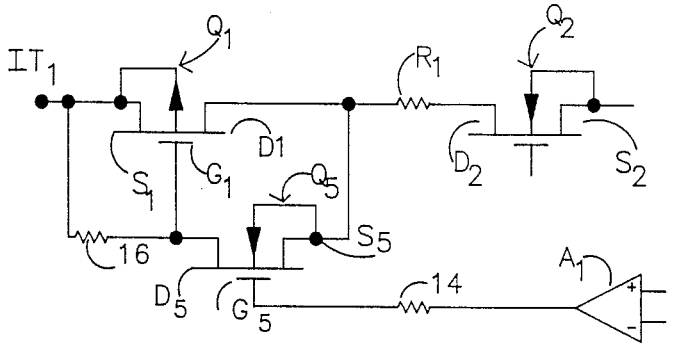
FIG. 1A is a schematic diagram of a level shifter for use in FIG. 1.

Reference is now made to FIG. 1A for a description of a circuit that can be used as the level shifter LS. Components corresponding to those of FIG. 1 are designated in the same manner and need not be further described. The output of $A_1$ is coupled via a resistor 14 to a gate $G_5$ of an N channel FET$Q_5$ having its source electrode $S_5$ connected to the drain electrode $D_1$ of $Q_1$ and its drain electrode $D_5$ connected to the gate $G_1$ and $Q_1$ and to the source electrode $S_1$ of $G_1$ and $IT_1$ via a resistor 16. As the control voltage for CC operation provided by $A_1$ increases, the resulting current drawn through the resistor 16 makes the gate $G_1$ more negative than it otherwise would be thereby increasing the impedance of $Q_1$ as required.

Figure 2:
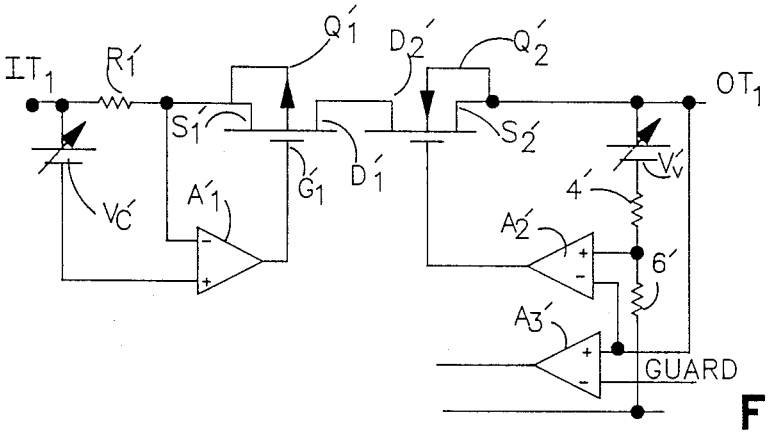
FIG. 2 is a schematic diagram of a portion of FIG. 1 that is altered so as to place the current sensing resistor between the FET's and the source of unregulated voltage.

Reference is now made to FIG. 2 illustrating a circuit that does not require a level shifter. Components corresponding in function to FIG. 1 are designated in the same manner primed. The principle difference is that the current sensing resistor $R_1'$ is connected between the source electrode $S_1$ of $Q_1$ and the input terminal $IT_1$.

Although not shown the resistor $R_1$ can be inserted between the source electrode $S_2$ of $Q_2$ and the output terminal $OT_1$ in which case a level shifter would be required.

Figure 3:
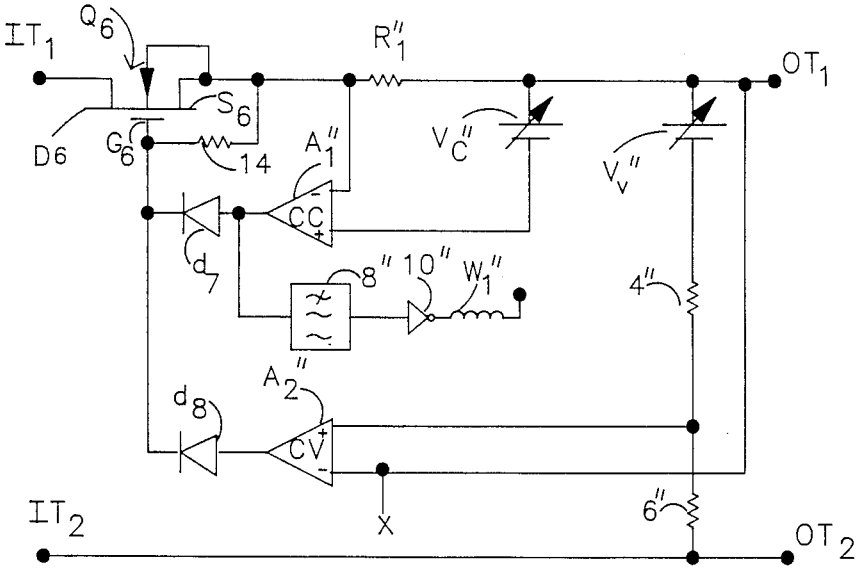
FIG. 3 is a schematic diagram of a portion of FIG. 1 that is altered so as to use only one FET for CV and CC operation.

FIG. 3 illustrates a portion of the circuit of FIG. 1 that would be involved if only one FET $Q_6$ is used for control in both the CC and CV modes of operation. Components corresponding in function to those of FIG. 1 are designated in the same manner with a double prime. $Q_6$ can be an N channel FET as shown if CV operation is favored or a P channel FET if CC operation is favored. In the latter case, a level shifter would be required and drain and source connections would have to be interchanged. In either case the removal of the output capacitor from the output circuit during the CC mode of operation and the desired maintainance of the voltage across it at the voltage between the output terminals would be performed in the same way as in FIG. 1. The x near the inverting input of $A_2''$ is the point x in FIG. 1. Diodes $d_7$ and $d_8$ are respectively connected between the outputs of $A_1''$ and $A_2''$ and the gate $G_6$ with the polarity shown so as to decouple $A_1''$ from $A_2''$. A resistor 14 is connected between $G_6$ and $S_6$ so as to prevent charge build-up from inadvertently saturating $Q_6$.

I claim:

1. A power supply for providing constant current or constant voltage comprising input terminals to which an unregulated D.C. voltage may be applied, output terminals between which an electrical load may be connected, an output capacitor connected between said output terminals, control means coupled between said input and output terminals for producing a selected value of D.C. voltage between said output terminals when in a first mode and for producing a selected current through a load connected to said output terminals when in a second mode, and switching means for disconnecting said output capacitor from at least one of said output terminals when said control means is in said second mode.

2. A power supply as set forth in claim 1 wherein means are provided for producing a voltage across said output capacitor equal to the voltage appearing between said output terminals when said control means is operating in said second mode.

3. A power supply as set forth in claim 1 wherein said control means is comprised of a P channel FET having a source—drain path between source and drain electrodes and a gate electrode, an N channel FET having a source—drain path between source and drain electrodes and a gate electrode, a resistor, connections for placing said resistor in series with the source—drain paths of said FETs between said first input terminal and said first output terminal such that the drain electrodes of said P channel FET and said N channel FET are respectively closer to said first input terminal and said first output terminal than their source electrodes, a first error amplifier having non-inverting and inverting inputs respectively connected to opposite ends of said resistor and an output, means for applying a first reference voltage to one of the inputs of said first error amplifier, means for coupling the output of said first error amplifier to said gate electrode of said P channel FET so as to make the constant current flowing to a load connected between said output terminals have a value that varies with said first reference voltage, a second error amplifier having non-inverting and inverting inputs and an output, a second source of a reference voltage, means for coupling the reference voltage supplied by said second source to one of said inputs of said second error amplifier, means for coupling said first output terminal to the other of said inputs of said second error amplifier, and means for coupling said output of said second error amplifier to the gate electrode of said N channel FET so as to make the constant voltage between said output terminals vary with said second reference voltage.

4. A power supply as set forth in claim 3 further comprising charging means coupled to said input terminals for supplying charge and discharge currents to said output capacitor when connected thereto in response to voltage appearing between said output terminals, and wherein said switching means connects said charging means to the side of said output capacitor that is remote from said second output terminal when said control means is in said second mode.

5. A power supply for providing constant current or constant voltage comprising:

input terminals to which an unregulated D.C. is to be applied, output terminals between which an electrical load is to be connected, an output capacitor and a switch connected in series between said output terminals, a pair of transistors and a resistor connected in series between one of said input terminals and one of said output terminals, first control means coupled to said output terminals and to one of said transistors for varying the impedance of said transistor so as to maintain voltage occuring between said output terminals at a preset value, CV, second control means coupled to said resistor and to the other of said transistors for varying the impedance of said other transistor so as to maintain current passing through said resistor at a present value, CC, said first control means having control when the current passing through said resistor is less than said present value CC and said second control means having control when the voltage between said output terminals is less than said preset value CV means coupled to said second control means for opening said switch when said second control means has control, and means responsive to the voltage between said output terminals for maintaining the voltage across said capacitor equal to the voltage when said second means has control.

6. A power supply for providing constant current or constant voltage comprising:

input terminals to which an unregulated D.C. is to be applied, output terminals between which an electrial load is to be connected, an output capacitor and a switch connected in series between said output terminals, a transistor and a resistor coupled in series between one of said input terminals and one of said output terminals, first control means responsive to voltage at said output terminals for varying the impedance of said transistor so as to maintain said voltage at a preset value CV as long as the current through said resistor is less than a preset value. CC, second control means responsife to the current flowing through said resistor for varying the impedance of said transistor so as to maintain said current at a preset value as long as the voltage between said output terminals is less than a preset value, means for keeping said switch in a conductive state while said first control means is varying the impedance of said transistor, and means for keeping said switch in a non-conductive state and for maintaining the voltage across said capacitor at the value of the voltage between said output terminals while said second control means is varying the impedance of said terminals.

* * * * *

UNITED STATES PATENT AND TRADEMARK OFFICE

CERTIFICATE OF CORRECTION

PATENT NO. : 4,816,740

DATED : March 28, 1989

INVENTOR(S) : Craig P. Maier

It is certified that error appears in the above-identified patent and that said Letters Patent is hereby corrected as shown below:

Column 1, line 16, "CV/CC$\geq$RL" should read -- CV/CC$\leq$RL

Column 6, line 40, "responsife" should read -- responsive --.

Signed and Sealed this

Nineteenth Day of March, 1991

*Attest:*

HARRY F. MANBECK, JR.

*Attesting Officer*

*Commissioner of Patents and Trademarks*